United States Patent [19]

Kronman et al.

[11] 4,257,696

[45] Mar. 24, 1981

[54] PHOTOGRAPHIC PRINTING APPARATUS

[75] Inventors: Albert F. Kronman, Locust Valley, N.Y.; Philip E. Hensy, Plantation, Fla.

[73] Assignee: Visual Graphics Corporation, Tamarac, Fla.

[21] Appl. No.: 95,153

[22] Filed: Nov. 19, 1979

[51] Int. Cl.[3] ..... B41B 17/06

[52] U.S. Cl. ..... 354/14; 354/12

[58] Field of Search ..... 354/5, 12, 13, 14, 15, 354/16, 17–19

[56] References Cited

U.S. PATENT DOCUMENTS

| | | | |
|---|---|---|---|
| 1,149,490 | 8/1915 | Bagge . | |
| 1,237,239 | 8/1917 | Bunnell . | |
| 1,732,049 | 10/1929 | Hunter . | |
| 1,798,109 | 3/1931 | Rankin . | |
| 1,893,439 | 1/1933 | Ogden . | |
| 2,537,069 | 1/1951 | Lohr . | |
| 2,742,830 | 4/1956 | Wirtz . | |
| 3,080,802 | 3/1963 | Friedel . | |
| 3,115,815 | 12/1963 | Friedel . | |
| 3,207,051 | 9/1965 | Cooper et al. | 354/17 |
| 3,209,664 | 10/1965 | Patrick . | |
| 3,308,732 | 3/1967 | Raak et al. . | |
| 3,552,284 | 1/1971 | Noble . | |
| 3,626,460 | 12/1971 | Miller . | |
| 3,626,830 | 12/1971 | Sobottka et al. | 354/12 |
| 3,667,356 | 6/1972 | Noble . | |
| 3,864,698 | 2/1972 | Holthusen . | |

FOREIGN PATENT DOCUMENTS

| | | | |
|---|---|---|---|
| 2849198 | 5/1979 | Fed. Rep. of Germany | 354/12 |

*Primary Examiner*—John Gonzales

*Attorney, Agent, or Firm*—Albert F. Kronman

[57] ABSTRACT

A photographic printing apparatus in which spaced photosensitive strips are secured to an image plane on top of a housing. An imaging font having two sets of identical symbols in spaced relationship is movably carried upon the housing overlying the photosensitive strips. Light is directed through selected portions of the imaging font upon one of the strips to form a latent image, which is subsequently developed and an instantly visible image on the other strip. The instantly visible image is used by the operator to space subsequent letters or symbols as the printing proceeds.

10 Claims, 9 Drawing Figures

VISUAL
VISUAL
VISUAL

PHOTOGRAPHIC PRINTING APPARATUS

BACKGROUND OF THE INVENTION

1. Field of the Invention

This invention relates to a photographic printing apparatus, and more particularly to an apparatus which can be operated in ambient light without the need for a darkroom.

Photographic printing devices which can be used outside of a darkroom have generally consisted of a master font of letters and a movable font mechanically linked together. The master font is positioned in such a manner that the letters carried on the master font can be imaged upon a photosensitive material carried within a light tight enclosure. In order for the operator to be able to space successive letters, various pointers, index scales, notches or indicia on the movable font have been utilized. In some instances, photosensitive material has been developed as each exposure is made and the apparatus is provided with a safe-light window through which the exposed letters can be viewed for positioning successive imaging.

Still another solution for the problem employs a phosphorescent material on a slave strip which produces a fleeting image of the exposed letter to aid the user in the placement of a succeeding letter prior to the next exposure.

It is the object of the present invention to provide a photographic printing apparatus of simple construction and relatively modest cost which may be operated in ambient light without the need for a darkroom.

A further object of the present invention is to provide a photographic printing apparatus which will produce high quality images on a permanent photosensitive material and also a visible slave strip of the images after each exposure.

Still another object of the present invention is to provide an apparatus by means of which precise spacing of the letters or symbols can be achieved by the operator as the photoprinting proceeds.

An object of the present invention is to provide a photographic printing apparatus in which different fonts of symbols and letters may be substituted as desired with a minimum of effort and using an inexpensive font structure.

Another object of the present invention is to provide an apparatus which insures accurate baseline orientation of successive letters or symbols.

SUMMARY OF THE INVENTION

A photographic printing apparatus according to the present invention comprises a rectangular housing having a plannar top portion which forms the exposure plane. The top portion is formed with a series of spaced, elongated, horizontal grooves. The grooves act as guides for a film font of letters or symbols which are slidable across the top portion for the purpose of bringing desired symbols into position for image exposure. The film font includes two sets of symbols, identical in nature bur vertically spaced from each other. One set forms positive images, the other negative.

The housing top portion exposure plane is adapted to receive a strip of photosensitive paper such as ultraviolet sensitive paper thereon. A second strip, of an instant image material, is also received upon the exposure plane parallel to but spaced from the first strip. The strips are overlain by the film font which can be moved across them.

An image exposure housing having at least one ultraviolet flash bulb therein is freely carried upon a track secured to the housing. The image exposure housing overlies both strips and both sets of symbols. By selectively sliding the film font upon the exposure plane, and advancing the exposure housing desired symbols can be brought into position with respect to the light sensitive strips. Electrical means carried by the exposure housing including the flash bulb are then activated to direct light through a symbol in one of the sets and upon to the photosensitive strip and also to direct light through a corresponding symbol in the other set upon the instant image material. A latent image is thus produced on the phosensitive strip and a visible image on the instant image strip. Successive symbols are brought into position suitably spaced from each other by reference to the visible image and exposed until the entire message or display is produced.

The photosensitive strip with all of the latent images thereon is finally imersed in developing solutions to produce a high quality permanent visible image.

BRIEF DESCRIPTION OF THE DRAWINGS

In the accompanying drawings forming part hereof, corresponding elements have been given the same reference numerals, in which drawings.

DETAILED DESCRIPTION

Figure 1:
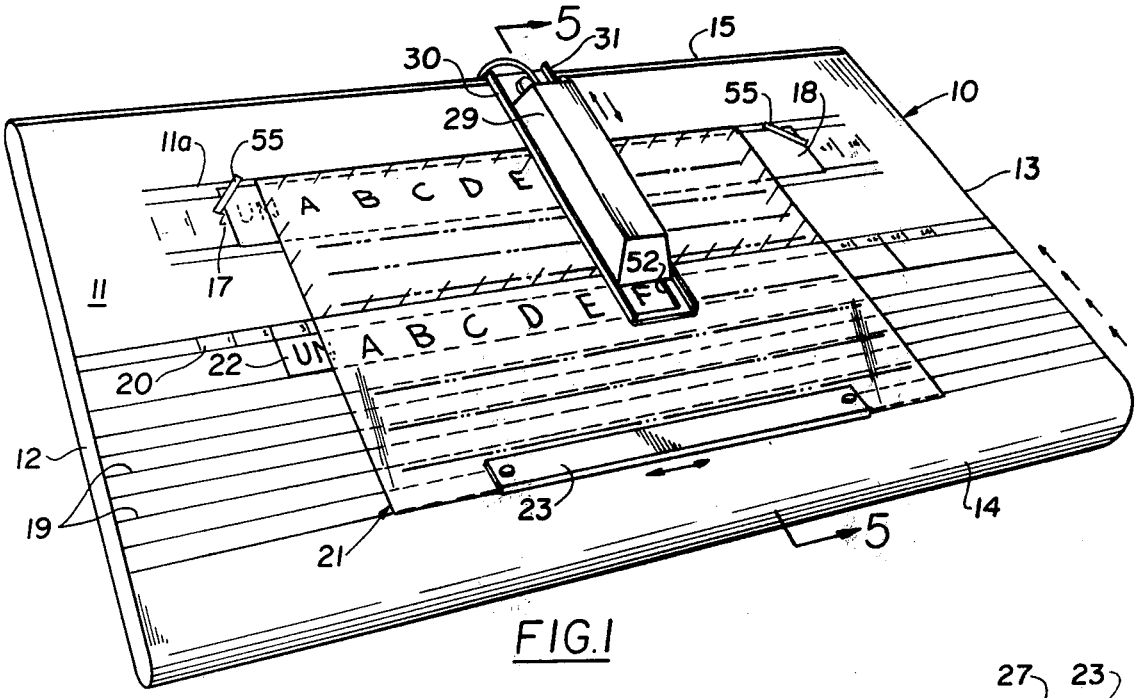
FIG. 1 is a somewhat isometric view of a photographic printing apparatus of the present invention shown on a reduced scale.

Referring to the drawings and particularly to FIGS. 1-4, there is shown a hollow housing 10 made of a suitable rigid material such as plastic or metal having a plannar top portion 11, spaced sides 12, 13, a font member 14, a rear member 15 and a bottom 16. The top portion 11 is provided with guide lines 11*a* and indicia 17 by means of which a strip of photosensitive material may be accuraely positioned and secured upon the surface of the top portion 11 which acts as the film plane of the photographic printing apparatus.

In order for the present device to be operated under normal or subdued room lighting conditions, the photosensitive material 18 is preferably one which is not highly sensitive to bright yellow fluorescent lighting or subdued white light. Such materials are well-known in the graphic arts field and may be obtained in paper or film form. The photosensitivematerial 18, however, is preferably sensitive to ultraviolet light with which the exposures are made to form latent images thereon.

A plurality of parallel, spaced, horizontal grooves 19 are cut or otherwise formed in the top portion 11 between the photosensitive stip guide lines 11*a* and the front member 14. Seven such grooves are shown for the purposes of illustration. In addition a second line of indicia 20 is located upon the top portion 11 between the guide line 11*a* and the first of the grooves, and parallel therewith to aid the operator in spacing of the letters and symbols being printed and placement of imaging material 22.

A film font of letters and symbols 21 consisting of a first set 21*a* and a second set 21*b* is freely placed upon the top portion 11 of the housing 10. The first set of letters and symbols, hereinafter referred to as the negative image omission upon the photosensitive strip 18 when light coming from a light source such as a Xenon bulb 42 which is rich in the ultraviolet component is directed through it. The second set of letters and symbols hereinafter referred to as the positive font 21*b* will produce a visible negative image upon a strip of light sensitive instant imaging proof material 22 such as is sold by Dupont under the trademark DYLUX, when exposed by the Xenon bulb 43.

The film font 21 is preferably made of a suitable transparent plastic material such as acetate upon which the two sets of symbols and letters have been produced by photographic or other techniques, well-known in the graphic arts technology.

Figure 4:
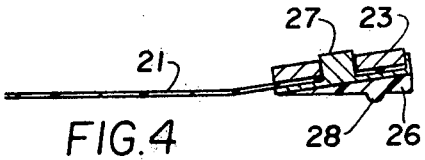
FIG. 4 is a sectional view taken on line 4—4 in FIG. 2.
Figure 2:
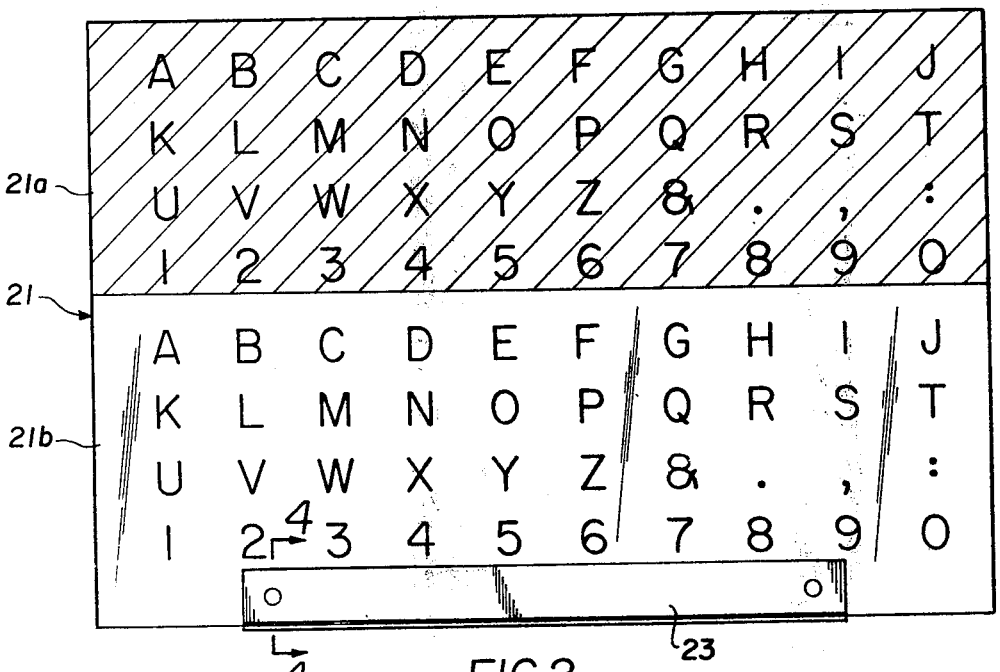
FIG. 2 is a plan view of a font sheet, on an enlarged scale, useful in the present invention.
Figure 3:
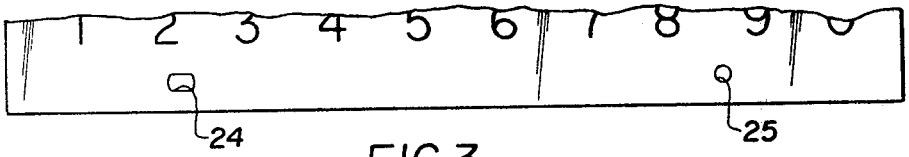
FIG. 3 is a fragmentary view of the font sheet with the font bar removed.

A rigid guide bar 23 made of metal or some suitable plastic material is secured at the end of the film font 21 below the positive font 21*b* as best shown in FIGS. 1, 2 and 4. The film font 21 is provided with openings 24, 25 (see FIG. 3) so that the said font can be positively grasped between the guide bar and a rigid follower 26 below the guide bar and coupled to it through the film font 21 by upstanding pins 27, as shown in FIG. 4. An elongated rib 28 which depends from the follower 26 is freely received within one of the grooves 19 and serves as a bearing member when the font 21 is moved laterallly across the top portion 11 of the housing 10.

It will be apparent that by shifting the rib 28 from one groove 19 to another the operator can bring any one of the desired lines of letters or symbols into position for exposure. Additionally, once positioned the lower edges of the letters will be aligned to provide a uniform base line in the resultant images.

Figures 5, 6, 7, 8, 9:
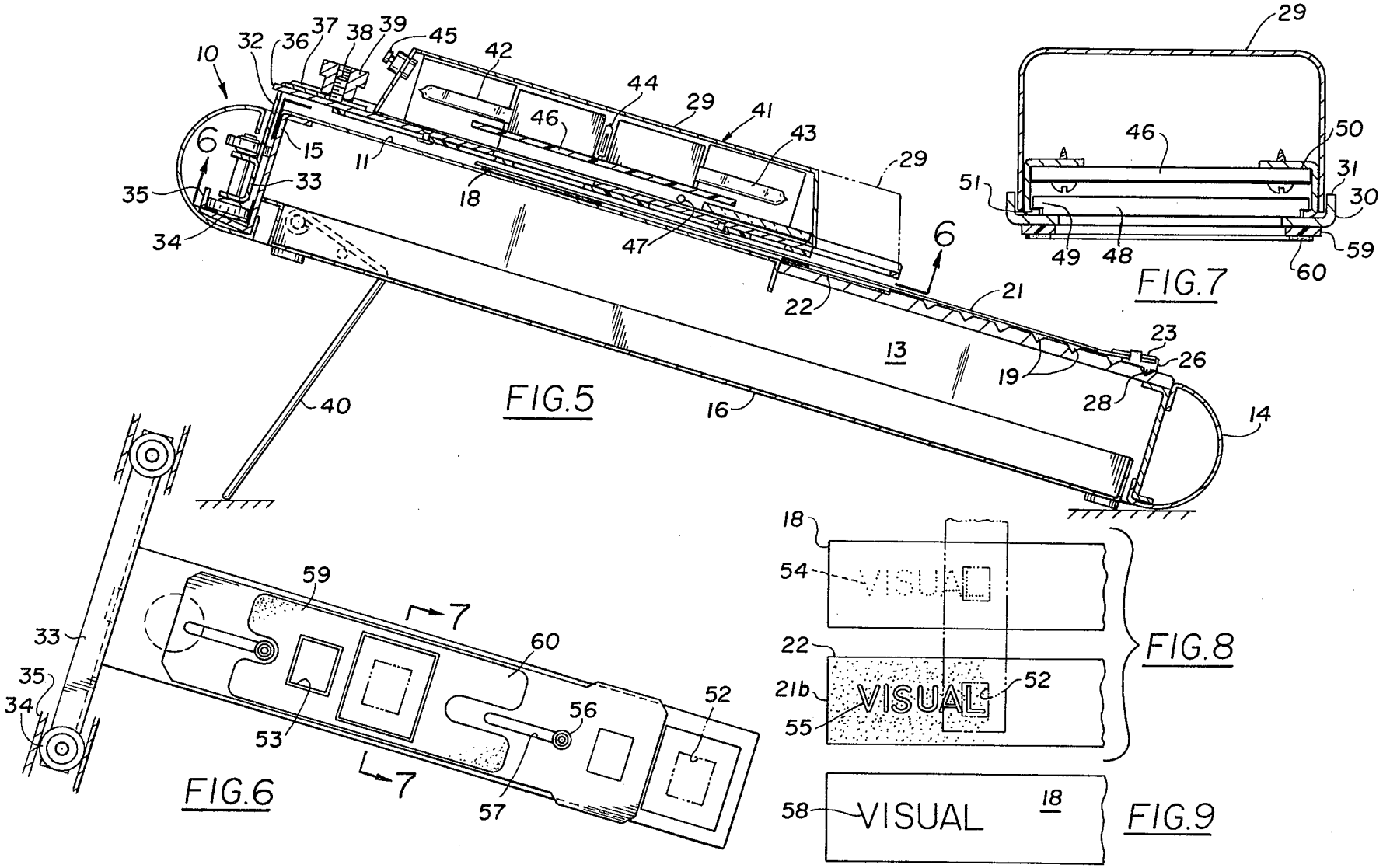
FIG. 5 is a sectional view taken on line 5—5 in FIG. 1.
FIG. 6 is a bottom view of the image exposure housing taken on line 6—6 in FIG. 5.
FIG. 7 is a sectional view, somewhat enlarged taken on line 7—7 in FIG. 6.
FIG. 8 is a schematic view of two strips of photosensitive material as they are exposed according to the present invention.
FIG. 9 shows a portion of photosensitve strip of material afater exposure and development.

An image exposure housing 29 is carried by the housing 10 so as to overlie the top portion 11 and the photosensitive and light sensitive strips 18, 22 as well as the film font 21 as shown in FIGS. 1 and 5. The image exposure housing 29 is further supported by an elongated track 30 of channel shape having the usual spaced upstanding edges 31. The track 30 is disposed normal to the grooves 19 and the image exposure housing 29 can move freely up and down the track. Attachment means 32 carried at the back of the housing 10 and secured to the track 30 hold the image exposure housing 29 in spaced relationship from the top portion 11 of the housing.

The attachment means 32 consist of a trolly 33 having four spaced wheels 34 at each end thereof as best shown in FIGS. 5 and 6. The lower wheels of the trolly ride within a channel shaped elongated plate 35 and the upper wheels bear against the rear member 15 of the housing 10. A bracket 36 secured at one end to the trolly is fastened at its upper portion 37 to the track 30 by means of a set screw 38 and nut 39. Since the housing 10 is tilted during use as shown in FIG. 5, the image exposure housing 29 is maintained in its desired position overlying the top portion 11 while being free to travel horizontally due to its support by the trolly 32. The tilted position of the housing 10 is made possible by legs 40 swingably secured to the housing 10 at the bottom thereof as shown in FIG. 5.

Referring to FIGS. 5, 6, and 7, there is shown in section and bottom plan the construction of the image exposure unit 41. This unit is contained within the image exposure housing 29 and in the preferred embodiment illustrated, a first and second Xenon flash bulb assembly 42, 43, is employed. A normally open switch 44 is carried upon a printed circuit and support board 46, which board also carries the said flashbulbs 42, 43. A small switch button 45 connected to the power source (not shown) is carried at the back of the image exposure housing 29. When the switch button is pressed the flashbulbs 42, 43 are fired to make the desired exposure. In order to prevent accidental firing of the flashbulbs, the normally opened switch 44 is provided with a contact which is closed by bringing it into register with a small permanent magnet 47 located on a plate 48 which is secured to and positioned within the track 30. The plate 48 is flanged as indicated in 49 to receive spaced brackets 50 secured to the printed circuit board 46 (as best shown in FIG. 7). The inwardly turned lower edges 51 of the brackets 50 form bearing surfaces upon which the image exposure housing slides within the track 30. The switch 44, therefore, can only be activated by the button 45 when the image exposure housing 29 is in the proper position for exposure.

Referring to FIGS. 8 and 9, there is illustrated the manner in which the exposure is made. When the proper symbol on the positive font 21*b* is brought into position, a small window 52 in the free end of the track 30 is brought into register with the letter or symbol to be printed. The image exposure housing 29 is pulled forward to the operator to the limit of its travel indicated by dashed lines in FIG. 5. At this juncture the housing 29 overlies an exposure aperture 53 in the track 30 which in turn is in register with the negative font 21*a*. When the exposure button 45 is pressed the two flashbulbs 42, 43, are activated to form a latent image of the letter indicated by the dotted lines 54 on the photosensitve strip in FIG. 8 and an instantly visible image 55 on the instant image material 22. Thereafter, the image exposure housing 29 is slid back to its original position so that the visible image previously printed can be observed by the operator. The next desired letter or symbol is brought into alignment by moving the film font 21 and visually spacing it from the preceding image. The exposure procedure is repeated until the entire word or message is spelled out on the instant image strip 22. When the printing is completed the photosensitive strip 18 is removed from the top portion 11 of the housing 10 as by peeling away the small fastening clips 55 which may be used to initially hold the said photosensitive strip in place during photoprinting. The photosensitive strip is then developed by means of solutions well-known in the art to produce a positive visible image.

Since the instant image strip 22 and photosensitve strip 18 are highly sensitve to ultraviolet light but also sensitive or other wavelengths in the Xenon bulbs; it is important that all other wavelengths are filtered out to prevent undesirable exposure effects on the photosensitive and instant image materials. For this purpose, an ulltraviolet band pass filter 59 is secured at the bottom of the track 30, as best shown in FIG. 7 to filter out all but ultraviolet light during each exposure. The band pass filter 59 is secured to and moves with the printed circuit support board 46 by reason of rivets 56 and slots 57, best shown in FIG. 6.

It would be assumed that since the letters or symbols on the positive portion of the font 21*b* occuply only parat of the transparent area exposed at each step in the printing operation that it would be diftficult to space the succeeding letter because of the darkening of the area within the window 52. It has been found, however, that the instant imaging material 22 will, if properly filtered, take a first exposure and still show sufficient contrast that the next letter can be brought into proper spacing position and exposed. The second exposure makes the overlapped portion still darker but the right hand portion of the newly exposed letter or symbol is still sufficiently light to permit the succeeding exposure. In addition, the entire instant imaging material can be read by the operator for a substantial period of time such as one hour after exposure so that the operator can interupt the printing operation and return to it without losing his place or running the risk of making a mistake in spelling.

While a single line of letters 58 has been shown in FIG. 9 as the developed product of the machine, it will be apparent to those skilled in the art that line over line printing can be achieved by moving the photosensitive strip 18 up or down and then resecuring it to the top portion of the housing by the small tapes 55.

In order to prevent accidental scratching of the film font 21, a small felt mask 60 is cemented to the lower surface of the ultraviolet band filter 59 as best shown in FIG. 7.

By using two Xenon lamps equally spaced above the photosensitive strip 18 and the instant imaging strip 22, the precise equal size and identical spacing of the visible and latent images are assured.

Having thus fully described the invention, what is claimed as new and desired to be securedby Letters Patent of the United States, is:

1. A photographic printing apparatus comprising a substantially rectangular housing, a plannar top portion on said housing, a first strip of photosensitive material removably secured to the top portion, a second strip of photosensitive instant imaging material spaced from the first strip and removably secured to the top portion, a film font having a first positive symbol forming porion and a second negative symbol forming portion secured to and freely slidable across the top portion overlying the first and second strips, an image exposure assembly carried by the housing above the two strip materials and horizontally and vertically slidable across the housing top portion, at least one flash bulb in said image exposure assembly and switch means for activatingthe flash bulb to direct light through selected portions of the first and second portions of the film font upon the first and secondstrips to form a latent and an instantly visible image on said first and second strips respectively.

2. Apparatus according to claim 1 in which the first and second strips are sensitive to ultraviolet light and the flash bulb is a source of ultraviolet light.

3. Apparatus according to claim 1 in which the top portion with at least one elongated groove parallel to but spaced from the photosensitive strips and the film font is provided with a guide bar secured to the said font and receivable within the said groove.

4. Apparatus according to claim 2 in which the housing is formed with a back portion and the image exposure assembly is carried at one end by a trolly supported by said back portion.

5. Apparatus according to claim 2 in which the image exposure assembly is provided with two Xenon flash bulbs.

6. Apparatus according to claim 4 in which the image exposure assembly is carried within a housing vertically slidable upon a track, coupled to the trolly.

7. Apparatus according to claim 4 in which the image exposure assembly contains a first and a second flash bulb, the track is channel shaped and provided with openings through which the ultraviolet light is directed upon the two photosensitive strips.

8. Apparatus according to claim 5 (and) or 7 in which a band pass filter for ultraviolet light is carried by the image exposure assembly between the flash bulbs and the photosensitive strips.

9. Apparatus according to claim 6 in which the image exposure assembly housing is provided with a window overlying the second photosensitive strip for spacing successive images.

10. Apparatus according to claim 5 or 7 in which a band pass filter for ultraviolet light is carried by the image exposure assembly between the flash bulbs and the photosensitive strips.

* * * * *